US005544874A

United States Patent [19]

DeFigueiredo

[11] Patent Number: 5,544,874

[45] Date of Patent: Aug. 13, 1996

[54] ANTI-SKEW DEVICE FOR ENVELOPE TURNER

[75] Inventor: Carlos L. DeFigueiredo, Sandy Hook, Conn.

[73] Assignee: Pitney Bowes Inc., Stamford, Conn.

[21] Appl. No.: 332,305

[22] Filed: Oct. 31, 1994

[51] Int. Cl.[6] ..... B65H 5/00

[52] U.S. Cl. ..... 271/2; 271/184; 271/298; 271/300; 271/302; 271/200; 271/246

[58] Field of Search ..... 271/245, 246, 271/225, 272, 274, 298, 300, 302, 184, 200, 2

[56] References Cited

U.S. PATENT DOCUMENTS 5,207,858 5/1993 DeBarber et al. ..... 271/2 X

*Primary Examiner*—David H. Bollinger

*Attorney, Agent, or Firm*—Lawrence E. Sklar; Melvin J. Scolnick

[57] ABSTRACT

Apparatus for turning an envelope. The apparatus includes: a pivotable feed deck for receiving an envelope; a device for stopping the envelope on the feed deck; a device for raising and lowering the downstream end of the feed deck; and a pivotable upper arm drive located above the feed deck. The drive is pivotable at its upstream end and includes a pair of feed rollers fixedly secured to the upstream end of the drive, a pair of exit rollers fixedly secured to the downstream end of the drive, and a pair of biased exit rollers secured to the drive adjacent and upstream of fixedly secured exit rollers.

5 Claims, 4 Drawing Sheets

ANTI-SKEW DEVICE FOR ENVELOPE TURNER

BACKGROUND OF THE INVENTION

The instant invention relates generally to envelope turning apparatus, and more particularly to an envelope turner which can feed large envelopes to a downstream envelope sealer without skewing the envelopes.

Machines for inserting documents and the like into envelopes are well known. These inserting machines are typically associated with an in-line mailing machine located downstream which prints the requisite postage on the stuffed envelope. However, prior to the postage being printed, it is usually necessary to turn the envelope 90 degrees or 180 degrees depending on the configuration of the metering equipment in relation to the inserting equipment. If the postage meter is oriented in the same direction as the discharge from the inserting equipment, a turn of 90 degrees is required for the envelope; if the postage meter is oriented 90 degrees to the direction of the inserting equipment, a turn of 180 degrees is required by the envelope.

In U.S. Pat. No. 5,207,858 issued May. 4, 1993 to the assignee of the instant invention and entitled "Ejection Apparatus For Modular Envelope Inserter", there is disclosed an envelope turner which is currently being used commercially in conjunction with an envelope inserting apparatus located upstream of the turner and a sealing device located downstream of the turner. Experience with this turner has shown that it works very well with small and medium size envelopes, but that with large envelopes, e.g. C5, 6.38" by 9:00", the envelopes can emerge from the turner with skew and thus not be properly aligned for the sealing device, which will cause a possible jam in the sealing device.

Accordingly, the instant invention provides an improvement to the envelope turner disclosed in the '858 patent which assures that envelopes of all sizes, including large envelopes, will emerge from the turner without skew, thereby preventing jams in any downstream apparatus, such as sealers.

SUMMARY OF THE INVENTION

Thus, the instant invention provides apparatus for turning an envelope. The apparatus includes: a pivotable feed deck for receiving an envelope; a device for stopping the envelope on the feed deck; a device for raising and lowering the downstream end of the feed deck; and a pivotable upper arm drive located above the feed deck. The drive is pivotable at its upstream end and includes a pair of feed rollers fixedly secured to the upstream end of the drive, a pair of exit rollers fixedly secured to the downstream end of the drive, and a pair of biased exit rollers secured to the drive adjacent and upstream of the fixedly secured exit rollers.

DETAILED DESCRIPTION OF THE PREFERRED EMBODIMENT

Figure 1:
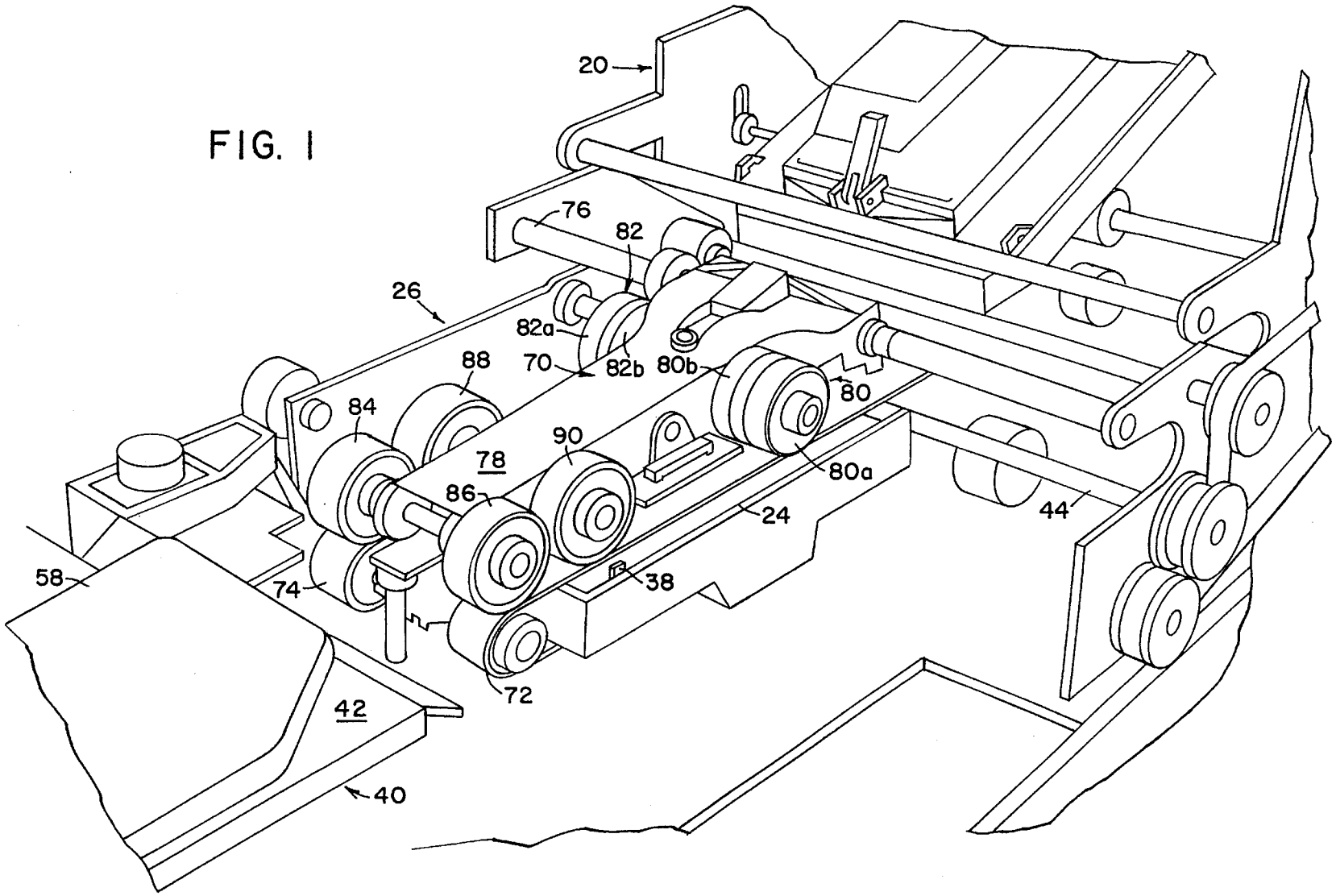
FIG. 1 is a perspective view of an envelope turner in accordance with the instant invention.

In describing the preferred embodiment of the instant invention, reference is made to the drawings, wherein there is seen in FIG. 1 a table-top inserter generally designated 20 which feeds and inserts documents (not seen) into an envelope 22. The stuffed envelope 22 is then fed onto a feed deck 24 of an envelope turning apparatus generally designated 26.

When an envelope 22 has been filled with inserted documents by the inserter 20 and sensors verify that the proper documents have been inserted, a pair of registration stop fingers 38 are raised and the envelope 22 is released by the inserter 20. The envelope 22 is fed to a position where it is stopped and aligned by the registration stops 38. Once the envelope 22 is resting against the stops 38, it is ready to be turned 90 degrees, which is effected by a spindle/geneva (not shown) located under the deck 24 and a shaft 44. The spindle/geneva is raised and rotated 90 degrees, which rotation turns the envelope 22 to align with a sealing device 40 downstream. Before the 90 degree rotation is effected, the stops 38 are retracted.

Properly filled envelopes 22 are then fed to the deck 42 of the sealing device 40 in order for the envelope flap to be moistened and sealed. It does happen occasionally that an envelope does not get stuffed because it was not properly opened, or an envelope becomes damaged. In these cases, there are sensors that recognize these situations and cause the unopened or damaged envelopes to be ejected from the flow of envelopes so that they do not enter the sealing device 40.

The envelope turner 26 is pivotably mounted at its upstream end on the shaft 44. The downstream end of the turner feed deck 24 includes a cam profile 46 which engages a cam 48. A motor 50 is connected to a gear box 52 which drives a shaft 54 which in turn drives the cam 48. A disk 56 having an encoder is mounted on the shaft 54 to ensure that the cam 48 is always stopped in the right position.

In operation, whenever an unopened or damaged envelope is sensed, a signal is sent to the motor 50 which, through the gear box 52, turns the shaft 54 and rotates the cam 48 against the cam profile 46 so that the turner feed deck 24 is raised. The unopened or damaged envelope 22, instead of being fed onto the deck 42 of the sealing device 40, is fed onto the top surface 58 of the sealing device 40 where it can be manually collected. The continued rotation of the cam 48 returns the feed deck 24 to its normal level so that envelopes 22 can be fed to the deck 42 of the sealing device 40.

Figure 2:
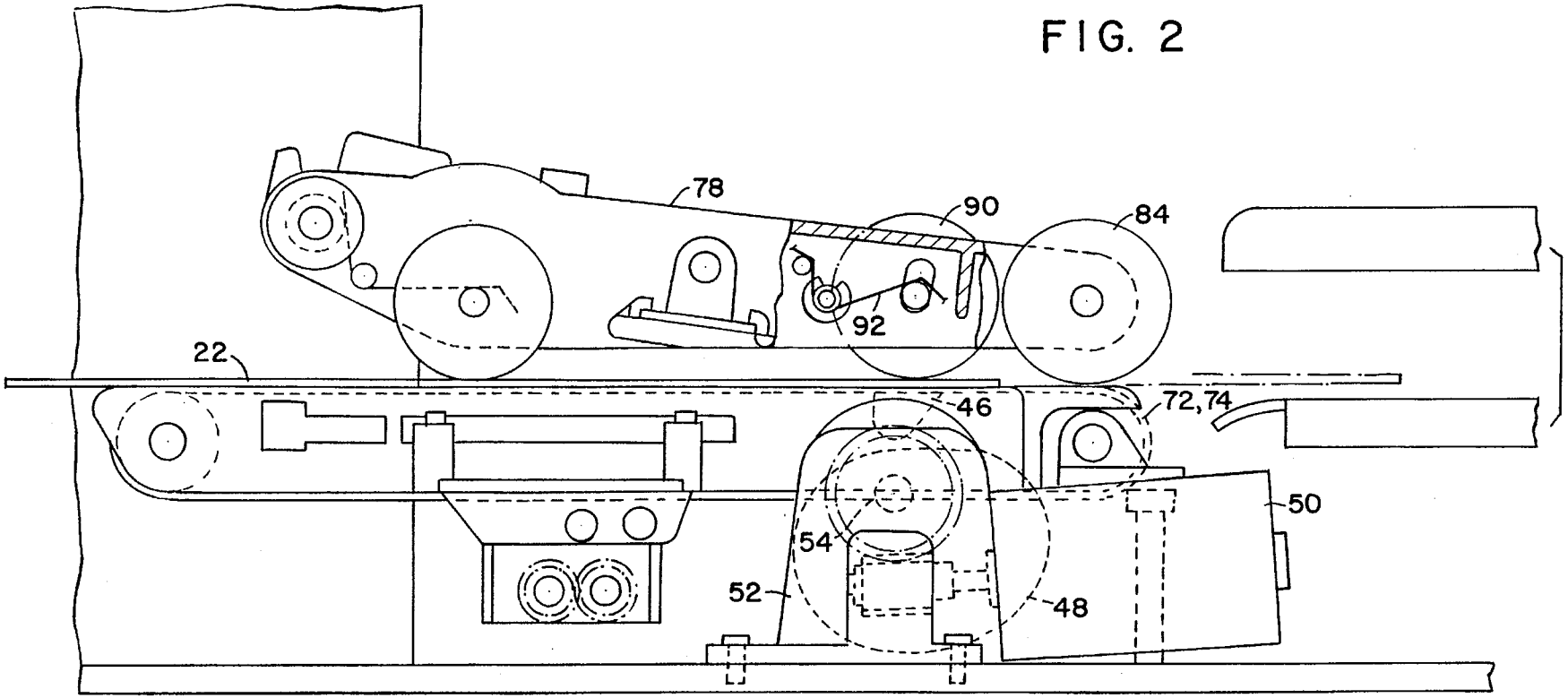
FIG. 2 is a side, elevational view of the envelope turner seen in FIG. 1.

The envelope turner 26 additionally includes an upper arm drive 70 which cooperates with a pair of continuously rotating belts 72 and 74 to move envelopes 22 out of the turner 26. The upper arm drive 70 is pivotably mounted at its upstream end to a shaft 76, and includes an arm 78 extending from the shaft 76. A pair of feed roller sets 80 and 82 are fixedly secured to the upstream end of the arm 78. Each set 80 and 82 extends from the side of the arm 78; the roller set 80 includes rollers 80*a* and 80*b*; and the roller set 82 includes rollers 82*a* and 82*b* (see FIG. 3). A pair of exit rollers 84 and 86 are fixedly secured to the downstream end of the arm 78 and extend from the sides of the arm 78. Immediately upstream and adjacent the fixed exit rollers 84 and 86 are a pair of biased exit rollers 88 and 90 which also extend from the sides of the arm 78. A pair of springs 92 (see FIG. 2) are housed in the arm 78 and bias the rollers 88 and 90 downward toward the deck 24. Although the biased exit rollers 88 and 90 are shown adjacent the fixed exit rollers 84 and 86, it is permissible for the biased rollers 88 and 90 to be somewhat spaced from the fixed rollers 84 and 86; obviously, if the biased rollers 88 and 90 are located too close to the feed rollers 80 and 82, the ability of the biased rollers 88 and 90 to eliminate skew from envelopes 22 emerging from the turner 26 is compromised.

Figure 3:
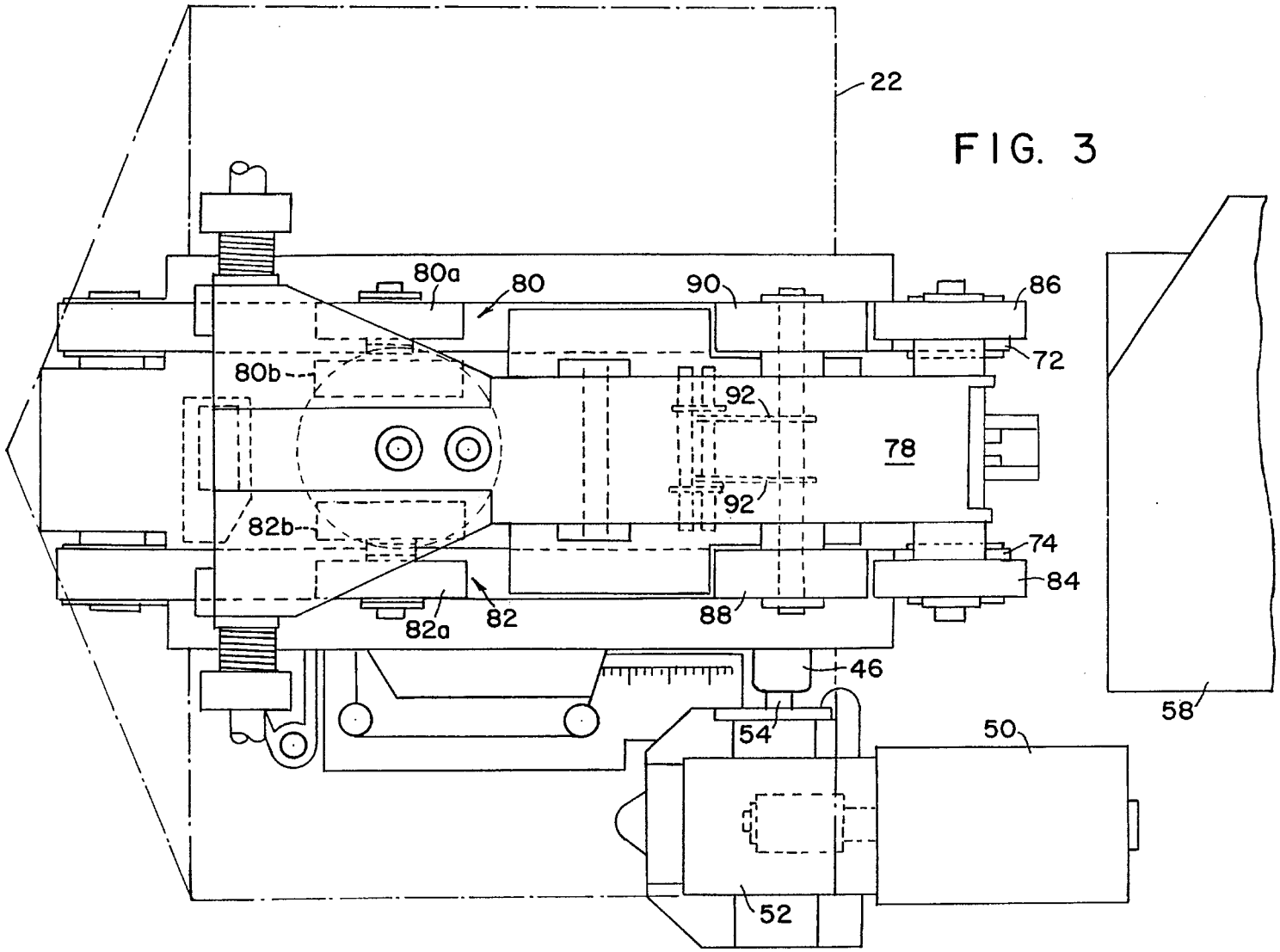
FIG. 3 is a top, plan view of the envelope turner seen in FIG. 1 with an envelope ready for turning.
Figure 4:
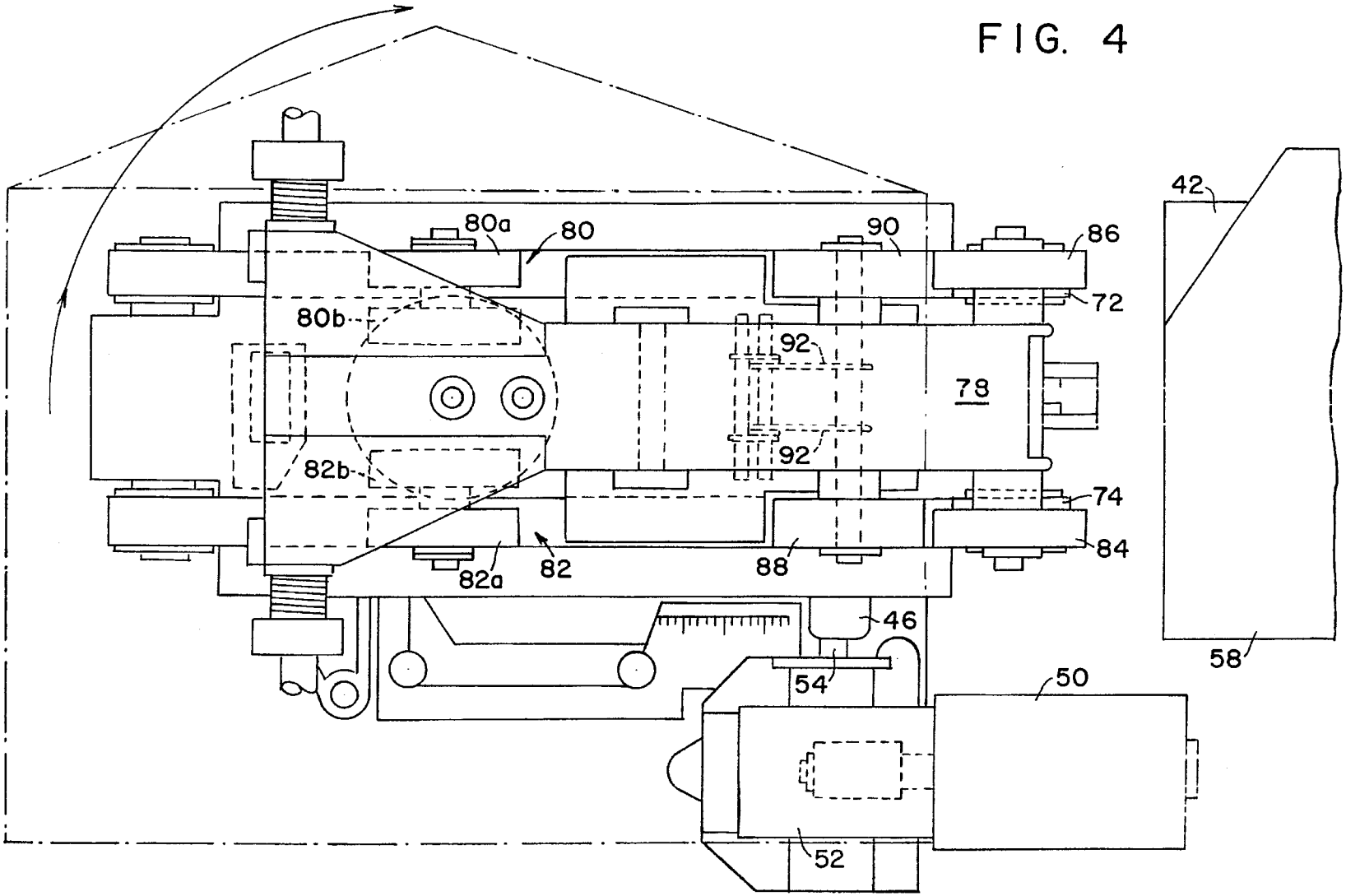
FIG. 4 is similar to FIG. 3 but shows the envelope having been turned.

From the foregoing description, it can be seen that an envelope 22 is received by the turner 26 from the inserter 20 in the position shown in FIG. 3. The envelope 22 is then lifted and rotated 90 degrees to the position seen in FIG. 4 and dropped on top of the driven belts 72 and 74. The envelope 22 is then driven out of the turner 26 by the belts 72 and 74 under the load of the feed roller sets 80 and 82 and the biased exit rollers 88 and 90 without skew.

It should be understood by those skilled in the art that various modifications may be made in the present invention without departing from the spirit and scope thereof, as described in the specification and defined in the appended claims.

What is claimed is:

1. Apparatus for turning an envelope, comprising:

a pivotable feed deck for receiving an envelope;

means for stopping said envelope on said feed deck;

means for raising and lowering the downstream end of said feed deck; and a pivotable upper arm drive located above said feed deck, said drive being pivotable at its upstream end, and including a pair of feed rollers fixedly secured to the upstream end of said drive, a pair of exit rollers fixedly secured to the downstream end of said drive, and a pair of biased exit rollers secured to said drive adjacent and upstream of said fixedly secured exit rollers.

2. The apparatus of claim 1, wherein said raising and lowering means comprises a cam profile secured to the downstream end of said feed deck and a cam for engaging said cam profile.

3. The apparatus of claim 2, additionally comprising an encoder operatively connected to said cam to ensure that said cam is stopped in a proper position.

4. The apparatus of claim 2, wherein said envelope stopping means comprises a registration stop finger movable between a first position projecting above said deck and a second position retracted below said deck.

5. The apparatus of claim 4, wherein said feed deck includes a continuously rotating belt for cooperation with said upper arm drive to remove said envelope from said feed deck to a downstream location.

* * * * *